US006923503B2

(12) United States Patent
Sangiorgio

(10) Patent No.: US 6,923,503 B2
(45) Date of Patent: Aug. 2, 2005

(54) CHAIR WITH MOVABLE SEAT AND BACKREST

(75) Inventor: Claudio Sangiorgio, Milan (IT)

(73) Assignee: ICF S.p.A., Vignate (IT)

( * ) Notice: Subject to any disclaimer, the term of this patent is extended or adjusted under 35 U.S.C. 154(b) by 0 days.

(21) Appl. No.: 10/674,503

(22) Filed: Oct. 1, 2003

(65) Prior Publication Data

US 2004/0075321 A1 Apr. 22, 2004

(30) Foreign Application Priority Data

Oct. 16, 2002 (IT) ..... MI2002A2194

(51) Int. Cl.[7] ..... A47C 1/02
(52) U.S. Cl. ..... 297/342; 297/300.3
(58) Field of Search ..... 297/318, 322, 297/342, 341, 300.1, 300.2, 317, 316, 344.18, 300.3

(56) References Cited

U.S. PATENT DOCUMENTS

| | | | | | |
|---|---|---|---|---|---|
| 809,944 | A | * | 1/1906 | Hanger | 297/342 |
| 2,492,106 | A | * | 12/1949 | Orton | 297/318 |
| 2,530,625 | A | * | 11/1950 | Nordmark | 297/324 |
| 3,252,734 | A | * | 5/1966 | Berlin | 297/317 |
| 4,429,917 | A | | 2/1984 | Diffrient | |
| 4,537,445 | A | * | 8/1985 | Neuhoff | 297/300.3 |
| 4,840,426 | A | | 6/1989 | Vogtherr et al. | |
| 4,848,837 | A | | 7/1989 | Volkle | |
| 5,810,440 | A | * | 9/1998 | Unwalla | 297/316 |
| 5,909,923 | A | | 6/1999 | DeKraker | |
| 6,467,842 | B1 | * | 10/2002 | Lu | 297/316 |
| 6,513,874 | B1 | | 2/2003 | Sander et al. | |
| 2002/0171276 | A1 | * | 11/2002 | Bock | 297/300.1 |

FOREIGN PATENT DOCUMENTS

DE 100 64 204 7/2002

* cited by examiner

*Primary Examiner*—Milton Nelson, Jr.
(74) *Attorney, Agent, or Firm*—Nixon & Vanderhye, P.C.

(57) ABSTRACT

A chair has a seat and a backrest, a structure supporting the seat, and a base. The support structure has two lateral uprights and at least one projecting element provided with a substantially longitudinal guide. The backrest is associated with two angled elements; each of the angled elements has a first end connected to the backrest, a central part connected rotatably by a first hinging pin to a top end of one of the uprights of the support structure of the seat, and a second end connected by a second hinging pin to the seat. The seat is connected to the support structure by a telescopic rod, which can be shortened and lengthened in a resilient manner, and an element which can be slidably engaged in the guide of the projecting element.

11 Claims, 4 Drawing Sheets

CHAIR WITH MOVABLE SEAT AND BACKREST

This application is based on Italian Patent Application No. MI2002A 002194 filed on Oct. 16, 2002, the content of which is incorporated hereinto by reference.

The present invention relates to a chair with a movable seat and backrest.

It is a commonly held view that chairs, in particular office chairs, should be adjustable ergonomically depending on the positions assumed by the user during the various conditions of intense, normal or relaxed working activity.

For this purpose various types of reclinable chairs, where the seat and backrest tilt simultaneously forwards or backwards, have been proposed.

In general, in these known chairs, the axis of rotation of the seat is in an intermediate position between the front end and the rear end of the seat or in the vicinity of the front end of the seat.

In known chairs where the axis of rotation of the seat is in an intermediate position between the front end and the rear end of the seat, when the backrest is reclined backwards the front part of the seat is raised with respect to the floor to a maximum distance from the floor allowed by the system used to adjust the inclination between backrest and seat. This movement of the seat raises the user's legs from the floor and the weight of the raised legs exerts an undesirable pressure on the rear side of the user's thighs.

Instead, in known chairs where the axis of rotation of the seat is situated in the vicinity of the front end of the seat, the user's legs are not raised when the backrest and the seat are inclined backwards because the distance between the front end of the seat and the floor remains constant.

However, lowering of the rear end of the seat tends to cause an undesirable backwards slipping movement of the user's pelvis and unpleasant pulling of his/her clothes.

In order to overcome these drawbacks, a chair in which the seat and the backrest tilt, performing different angular rotations, has been proposed.

U.S. Pat. No. 4,429,917 describes a chair of this second type which comprises a seat, a backrest and a hinged parallelogram, said hinged parallelogram comprising a support, said seat forming a second connection of said hinged parallelogram, said hinged parallelogram comprising a third connection having an end portion rotatably connected to a rear portion of said support and an opposite end portion rotatably connected to a rear portion of said seat, a fourth connection having a first end portion rotatably connected to a front portion of said support and a second end portion rotatably connected to a front portion of said seat, and means for mounting and fixing said backrest to said fourth connection so as to perform a rotational movement together with said fourth connection about said rotatable connection between said fourth connection and said support.

In this chair, the centre of instantaneous rotation of the hinged parallelogram is situated underneath the seat and, while the backrest and the seat tilt backwards at different angles of rotation, the seat moves backwards towards the backrest. In the embodiment of the chair described in the abovementioned document, the angle of inclination of the seat is equal to about one third of the angle of inclination of the backrest. According to the abovementioned document (column 6, lines 35–39), this reduced inclination of the seat has the purpose of allowing the user to keep his/her feet on the floor and avoid slipping of the pelvis.

A first disadvantage of the chair described in U.S. Pat. No. 4,429,917 is that its structure is complex and therefore the production thereof is costly.

Moreover, it must be considered that the body of a person who is working sat at a desk is continuously moving. In order to safeguard the person's health, the chair should therefore allow the person to assume the most widely varying natural positions required by the work being performed without moving away from the desk.

This is not allowed, however, either by the chair described in U.S. Pat. No. 4,429,917, nor by other known chairs in which a backwards inclination of the user's trunk results in a backwards displacement of the entire body and a consequent movement away from the work station. Thus, for example, the eyes move away from the monitor and the hands move away from the mouse, forcing the user to assume unnatural and therefore damaging positions.

A first object of the present invention is to design a chair which is provided with a movable backrest and seat and does not have the abovementioned drawbacks.

A second object of the present invention is to design a chair which is provided with a movable backrest and seat and has a robust structure and is simple and low cost to construct.

A third object of the present invention is to provide a chair which is provided with a movable backrest and seat in which the movement is achieved by means of simple modifications of the components conventionally used to construct a chair with a fixed backrest and seat.

The abovementioned object is achieved, in accordance with the invention, by means of a chair having a seat, a backrest, a structure supporting the seat, and a base, characterized in that said support structure has two lateral uprights and at least one projecting element provided with a substantially longitudinal guide, in that said backrest is associated with two angular elements, each of said angular elements having a first end connected to said backrest, a central part connected rotatably by means of a first hinging pin to a top end of one of said uprights of said seat support structure and a second end connected to said seat by means of a second hinging pin, said seat being connected to said support structure also by means of a telescopic rod which can be shortened and lengthened in a resilient manner, and an element slidably engaged in said guide of said projecting element so that a backwards rotation of said backrest about the first hinging pins causes forwards sliding of said seat and vice versa.

An important characteristic feature of the chair according to the invention is that the first hinging pins which rotatably connect the angular elements, which are joined to the backrest, to the seat support structure are situated above the seat. This allows the abovementioned first hinging pins to be positioned such that the imaginary axis which connects them coincides with the main imaginary axis of rotation of the body of the user in the seated position. Typically, this imaginary axis of rotation connects the two hips of the user and is situated at about 60–100 mm above the plane of the seat.

This typical arrangement of the first hinging pins and the particular type of mechanism envisaged in the chair according to the invention allows a particular synchronized movement of the backrest and the seat such that a backwards inclination of the backrest results in a translatory forward movement of the seat, and vice versa, with a minimum displacement in the centre of gravity of the user's body.

In this way, the backwards counter-thrust exerted by the weight of the user automatically balances the resilient reaction of the telescopic rod.

This allows the degree of resilient reaction of the telescopic rod to be reduced.

These movements of the backrest and the seat assist, therefore, in a natural and ergonomic manner the movements of the user's body.

This will allow the person sitting in the chair to continue performing his/her work, such as for example the movement of a mouse, also during the forwards and backwards movements of the backrest.

In a preferred embodiment, the seat according to the present invention is raised upwards through 3–7°, preferably about 5°, while the backrest tilts backwards through about 20–30°.

Preferably, the ratio between the angles of inclination of the seat and the backrest range from about 1:10 to 1:5, even more preferably it may be about 1:6.

Another advantage of the chair according to the invention is its constructional simplicity due to the limited number of components.

Advantageously, the abovementioned slight raising movement of the seat according to the invention is obtained by inclining slightly the sliding guide, and therefore the sliding plane, of the seat with respect to the surface (floor) on which the chair is placed.

Another advantage of the chair according to the invention is its constructional simplicity due to the limited number of components; in particular, without using a special moving device, but by suitably connecting together the conventional structural components of a chair: i.e. base, seat and backrest.

Other characteristic features and advantages of the invention will now be illustrated with reference to two embodiments shown by way of a non-limiting example in the accompanying drawings, in which.

Figure 1:
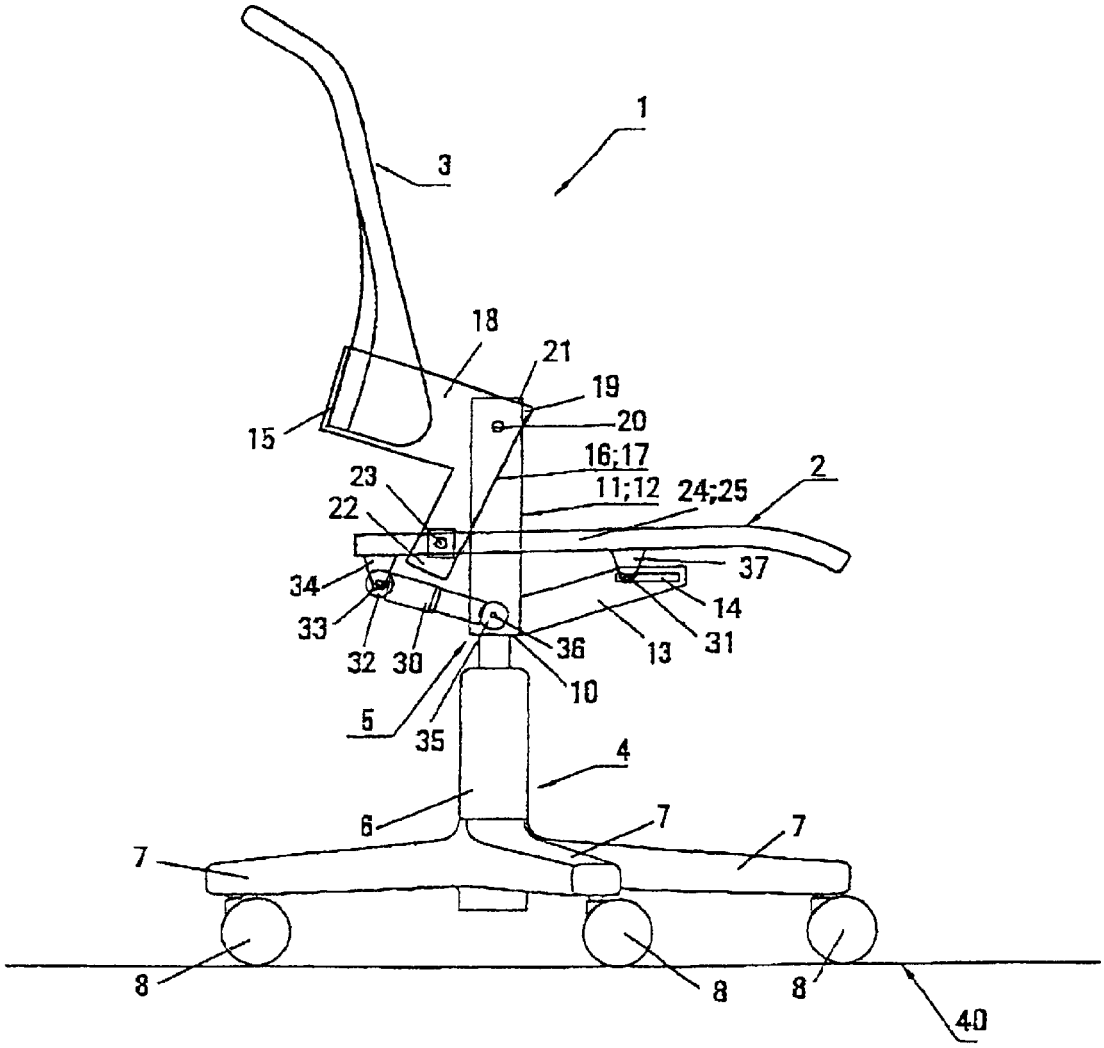
FIG. 1 is a side view of a chair according to a first embodiment of the present invention.
Figure 2:
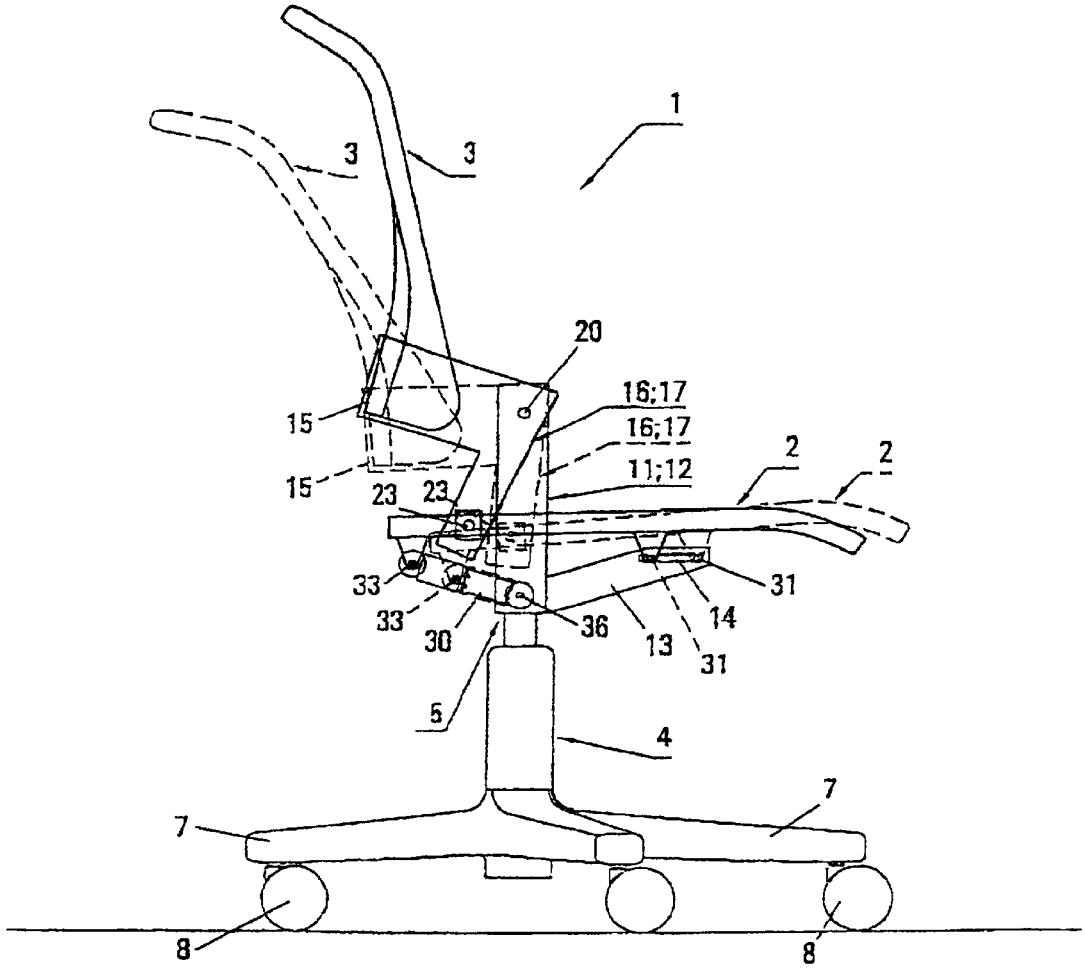
FIG. 2 shows the chair according to FIG. 1 in the condition where the backrest is vertical (continuous lines) and in the condition where the backrest is inclined backwards (broken lines)
Figure 3:
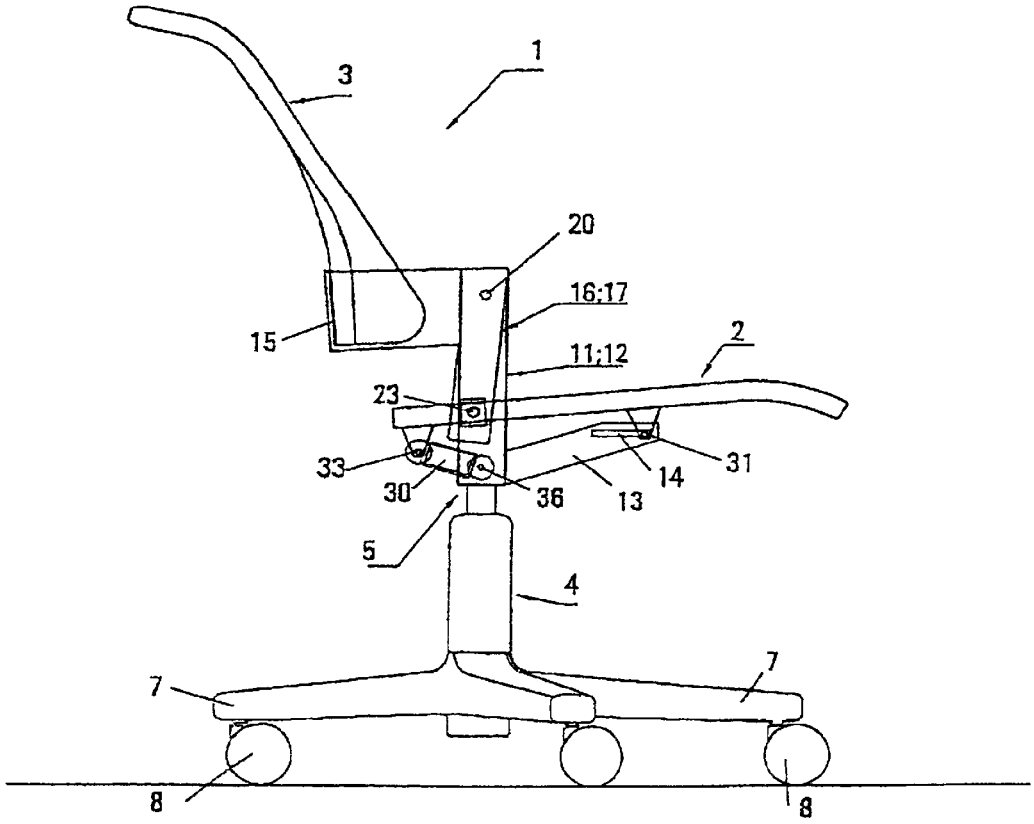
FIG. 3 shows the chair according to FIG. 1 in the condition where the backrest is inclined backwards.

FIGS. 1–3 show a chair 1 having a movable seat 2 and backrest 3, a base 4 and a structure 5 supporting the seat 2.

The base 4 comprises a telescopic column 6 provided with radial legs 7 and swivel wheels 8 which rest on a floor 40.

The structure 5 supporting the seat 2 comprises a cross-piece 10, two lateral uprights 11 and 12 integral with the cross-piece 10 and forming a mirror image of each other, as well as a longitudinal projecting element 13 directed towards the front part of the chair. The projecting element 13 has a slide-type guide 14 which is substantially longitudinal and formed by an eyelet, the function of which will be illustrated further below.

Advantageously, armrests (not shown) may be connected to the lateral uprights 11 and 12, thus being adjustable heightwise in a simple and effective manner.

The backrest 3 is integrally joined to a curved transverse band 15 which is connected to two lateral angular elements 16 and 17 which are a mirror image of each other. Each angular element 16 or 17 (which could be a right angle element) has a first end 18, a central part 19 and a second end 22. The end 18 is integrally joined to the transverse band 15 by means of known fixing methods (not shown). The central part 19 is rotatably connected, by means of a hinging pin 20 to a top end 21 of an upright 11 or 12 of the structure 5 supporting the seat 2. The end 22 is rotatably connected by means of a hinging pin 23 to a side 24 or 25 of the seat 2.

The hinging pins 20 are situated above the seat 2, at a height of about 80 mm, so that they are substantially aligned with the imaginary axis which connects the hips of the user in the seated position.

The seat 2 is connected at the bottom to the support structure 5 by means of a telescopic rod 30 which can be shortened and lengthened in a resilient manner and a pin (or a wheel) 32 slidably engaged in the eyelet (slide-type guide) 14 of the projecting element 13. The rod 30 has ends 32 and 35. The end 32 is connected by means of a hinging pin 33 to a plate 34 fixed to the seat 2 and the end 35 is connected by means of a hinging pin 36 to the cross-piece 10 of the structure 5 supporting the seat 2. The pin 31 is mounted on a plate 37 fixed to the seat 2.

The telescopic rod 30 is of the metallic spring or pneumatic type, not shown, having a pre-tensioning force capable of keeping the seat 2 and the backrest 3 in the initial position shown in FIG. 1.

When the user wishes to incline the chair 1, he/she exerts, with the trunk of the body, a pushing force on the backrest 3 directed backwards. The backwards inclination of the backrest 3 causes a forwards translation of the seat 2 and a simultaneous slight tilting thereof upwards (FIGS. 2 and 3). The backrest 3, rotating in an anti-clockwise direction about the hinging pins 20, causes the forwards displacement of the seat 2 and slight tilting thereof by means of the mechanisms comprising the right-angle elements 16 and 17, the hinging pins 20 and 23, the telescopic rod 30, the pin 31 and the eyelet 14. With the forwards displacement of the seat, the telescopic rod 30 is shortened and its spring is compressed into a predefined stop position corresponding to the predefined maximum inclination of the backrest, where it provides a resilient reaction capable of bringing the seat 2 and the backrest 3 back into the initial position (FIGS. 1 and 2) when the user ceases pushing against the backrest.

Figure 4:
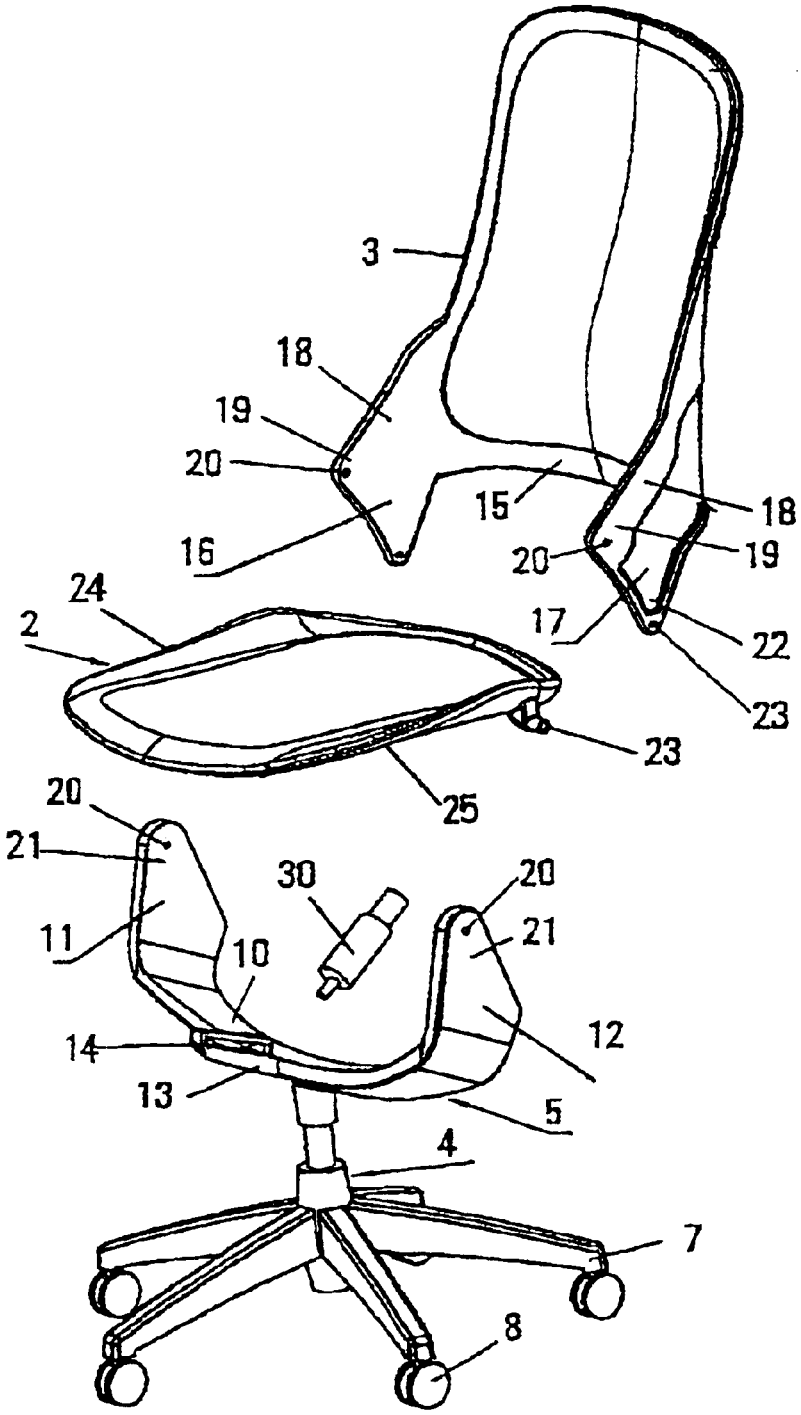
FIG. 4 is an exploded view of a chair according to a second embodiment of the invention.

FIG. 4 shows a second embodiment of the chair 1 according to the invention, in which the same reference numbers are used to indicate the same parts shown in FIGS. 1–3.

This second embodiment according to FIG. 4 differs from that of FIGS. 1–3 simply in that the right-angle elements 16 and 17 are integral with the backrest 3, being formed as one piece by means of moulding.

The person skilled in the art will easily understand that it is possible to make numerous modifications to the two embodiments illustrated without, however, departing from the invention claimed.

What is claimed is:

1. A chair having a seat and a backrest, a structure supporting the seat, and a base, wherein said support structure has two lateral uprights and at least one projecting element provided with a substantially longitudinal guide, in that said backrest is associated with two angular element, each of said angular elements having a first end connected to said backrest, a central part connected rotatably by means of a first hinging pin to a top end of one of said uprights of said structure supporting the seat and a second end connected to said seat by means of a second hinging pin, said seat being connected to said support structure also by means of a telescopic rod which can be shortened and lengthened in a resilient manner, and an element slidably engaged in said guide of said projecting element so that a backwards rotation of said backrest about the first hinging pins causes forwards sliding of said seat and vice versa.

2. A chair according to claim 1, wherein the first hinging pins of said angular elements are situated above said seat.

3. A chair according to claim 2, wherein said first hinging pins of said angular elements are positioned such that an imaginary axis which connects them coincides substantially with an imaginary axis which connects two hips of a user.

4. A chair according to claim 1, wherein said first hinging pins are situated at about 60–100 mm above the plane of the seat.

5. A chair according to claim 1, wherein said guide is parallel to a surface on which said chair is placed.

6. A chair according to claim 1, wherein said guide is slightly inclined with respect to a surface on which said chair is placed.

7. A chair according to claim 6, wherein said seat is raised upwards through 3–7°.

8. A chair according to claim 7, wherein said seat is raised upwards through 5°.

9. A chair according to claim 6, wherein said backrest is inclined backwards through 20–30°.

10. A chair according to claim 6, wherein a ratio between angles of inclination of the seat and the backrest ranges from 1:10 to 1:5.

11. A chair according to claim 10, wherein the ratio between the angles of inclination of the seat and the backrest is about 1:6.

* * * * *